US008848873B2

(12) United States Patent
Duhamel

(10) Patent No.: US 8,848,873 B2
(45) Date of Patent: Sep. 30, 2014

(54) X-RAY IMAGING SYSTEM WITH CABLING PRECHARGING MODULE

(75) Inventor: Eric V. Duhamel, Boxborough, MA (US)

(73) Assignee: Medtronic Navigation, Inc., Louisville, CO (US)

( * ) Notice: Subject to any disclaimer, the term of this patent is extended or adjusted under 35 U.S.C. 154(b) by 386 days.

(21) Appl. No.: 13/013,087

(22) Filed: Jan. 25, 2011

(65) Prior Publication Data

US 2012/0189103 A1 Jul. 26, 2012

(51) Int. Cl.

| | |
|---|---|
| ***H05G 1/32*** | (2006.01) |
| ***H05G 1/34*** | (2006.01) |
| ***H05G 1/10*** | (2006.01) |
| ***H05G 1/56*** | (2006.01) |

(52) U.S. Cl.

CPC ... *H05G 1/56* (2013.01); *H05G 1/10* (2013.01)
USPC ..... 378/111; 378/109

(58) Field of Classification Search

CPC ..... H05G 1/10; H05G 1/32; H05G 1/34; H05G 1/48
USPC ..... 378/106, 108, 109, 110, 111, 112
See application file for complete search history.

(56) References Cited

U.S. PATENT DOCUMENTS

| | | | | |
|---|---|---|---|---|
| 5,876,229 | A | 3/1999 | Negle | |
| 7,818,044 | B2 | 10/2010 | Dukesherer et al. | |
| 2003/0133534 | A1 * | 7/2003 | Bothe et al. | 378/16 |
| 2009/0009918 | A1 | 1/2009 | Beland | |

FOREIGN PATENT DOCUMENTS

| | | | |
|---|---|---|---|
| DE | 618919 C | * | 9/1935 |
| JP | 2001250497 A | * | 9/2001 |
| WO | WO-2012109009 A1 | | 8/2012 |

OTHER PUBLICATIONS

ECN Electrical Forum (Discussion Forums for Electricians, Inspectors and Related Professionals) [online]. (May 2002)[retrieved Apr. 6, 2013]. Retrieved from the Internet: <http://www.electrical-contractor.net/forums/ubbthreads.php/topics/128042/why_do_we_parallel_conductors.html>.*

"Medtronic O-Arm Multi-Dimensional Surgical Imaging System"; Brochure, 24pp, 2009.

Seibert, J. Anthony; "X-Ray Imaging Physics for Nuclear Medicine Technologists," pp. 1-17; 2004.

International Preliminary Report on Patentability and Written Opinion mailed Aug. 8, 2013 for PCT/US2012/022365, which claims of U.S. Appl. No. 13/022,542, filed Feb. 7, 2011.

International Search Report and Written Opinion mailed Apr. 24, 2012 for PCT/US2012/022365, which claims of U.S. Appl. No. 13/022,542, filed Feb. 7, 2011.

* cited by examiner

*Primary Examiner* — Glen Kao
(74) *Attorney, Agent, or Firm* — Harness, Dickey

(57) ABSTRACT

An X-ray imaging system can include an X-ray tube, an X-ray generator, a precharging module and a triaxial cable. The X-ray tube can be configured to generate an X-ray emission and include an anode, a cathode and a filament. The X-ray generator can be coupled with the X-ray tube and include a high voltage module and a low voltage module. The high voltage module can be being configured to supply a dosing voltage across the X-ray tube and the low voltage module can be configured to supply a dosing current to the filament. The precharging module can be configured to supply a precharge voltage. The triaxial cable can electrically connect the X-ray generator to the X-ray tube. The outer shield conductor of the triaxial cable can carry a ground voltage, the inner shield conductor can carry the precharge voltage and the center conductor can carry the dosing voltage.

38 Claims, 3 Drawing Sheets

X-RAY IMAGING SYSTEM WITH CABLING PRECHARGING MODULE

FIELD

The present disclosure relates to X-ray imaging systems and, more particularly, to an improved X-ray imaging system that provides greater image quality and more precise dosage control.

BACKGROUND

This section provides background information related to the present disclosure which is not necessarily prior art.

Conventional X-ray imaging systems include an X-ray generator coupled with an X-ray tube by a coaxial cable. In typical X-ray imaging systems, the center conductor of the coaxial cable carries the high voltage signal sent from the X-ray generator to the X-ray tube, while the shield conductor remains grounded. In this construction, the coaxial cable may be charged over a relatively long period of time due to the capacitance between the center and shield conductor. This charging delay can result in an increased rise and/or fall time for the high voltage signal pulse, which can lead to poor image quality and dosage control.

It would be desirable to provide an X-ray imaging system that provides for improved image quality and dosage control by reducing the charge time of the cable connecting the X-ray generator to the X-ray tube.

SUMMARY

This section provides a general summary of the disclosure, and is not a comprehensive disclosure of its full scope or all of its features.

In various embodiments of the present disclosure, an X-ray imaging system can include an X-ray tube, an X-ray generator, a precharging module and a triaxial cable. The X-ray tube can be configured to generate an X-ray emission and include an anode, a cathode and a filament. The X-ray generator can be coupled with the X-ray tube and include a high voltage module and a low voltage module. The high voltage module can be being configured to supply a dosing voltage across the X-ray tube and the low voltage module can be configured to supply a dosing current to the filament. The precharging module can be coupled with the X-ray generator and be configured to supply a precharge voltage. The triaxial cable can electrically connect the X-ray generator to the X-ray tube. The triaxial cable can include a center conductor, an inner shield conductor surrounding the center conductor and an outer shield conductor surrounding the center conductor and the inner shield conductor. The outer shield conductor can carry a ground voltage, the inner shield conductor can carry the precharge voltage and the center conductor can carry the dosing voltage.

According to various embodiments of the present disclosure, an X-ray imaging system can include an X-ray tube, an X-ray generator, a precharging module and a triaxial cable. The X-ray tube can be configured to generate an X-ray emission. The X-ray tube can include an anode, a cathode and a filament. The X-ray generator can be coupled with the X-ray tube and include a high voltage module and a low voltage module. The high voltage module can be configured to supply a dosing voltage across the X-ray tube and the low voltage module can be configured to supply a dosing current to the filament. The precharging module can be coupled with the X-ray generator and be configured to supply a precharge voltage. The precharge voltage can be based on a dosing indicator signal output by the high voltage module. The triaxial cable can be electrically connected to the X-ray generator to the X-ray tube. The triaxial cable can include a center conductor, an inner shield conductor surrounding the center conductor and an outer shield conductor surrounding the center conductor and the inner shield conductor. The outer shield conductor can carry a ground voltage, the inner shield conductor can carry the precharge voltage and the center conductor can carry the dosing voltage.

Further, according to various embodiments of the present disclosure a method of operating an X-ray imaging system is disclosed. The method can include providing an X-ray tube configured to generate an X-ray emission and an X-ray generator. The X-ray tube can include an anode, a cathode and a filament. The method can also include connecting the X-ray tube to the X-ray generator with a triaxial cable. The triaxial cable can include a center conductor, an inner shield conductor surrounding the center conductor and an outer shield conductor surrounding the center conductor and the inner shield conductor. The method can also include the steps of supplying a precharge voltage to the inner shield conductor of the triaxial cable and, while supplying a precharge voltage to the inner shield conductor, supplying a dosing voltage across the X-ray tube. The dosing voltage can be carried by the center conductor of the triaxial conductor. The method can further include supplying a dosing current to the filament to while supplying the dosing voltage across the X-ray tube to generate an X-ray emission.

Additionally, an X-ray imaging system can include an X-ray tube, an X-ray generator, a precharging module, a connector cable and two triaxial cables. The X-ray tube can be configured to generate an X-ray emission and include an anode, a cathode and a filament. The X-ray generator can be coupled with the X-ray tube and include a high voltage module and a low voltage module. The high voltage module can be being configured to supply a dosing voltage across the X-ray tube and the low voltage module can be configured to supply a dosing current to the filament. The precharging module can be coupled with the X-ray generator and be configured to supply a precharge voltage. The connector cable can electrically connect the low voltage module to the X-ray tube. The triaxial cables can electrically connect the high voltage module to the X-ray tube. Each of the triaxial cables can include a center conductor, an inner shield conductor surrounding the center conductor and an outer shield conductor surrounding the center conductor and the inner shield conductor. The outer shield conductor can carry a ground voltage, the inner shield conductor can carry the precharge voltage and the center conductor can carry the dosing voltage. The precharge voltage can be based on the dosing voltage to reduce capacitance of the two triaxial cables.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
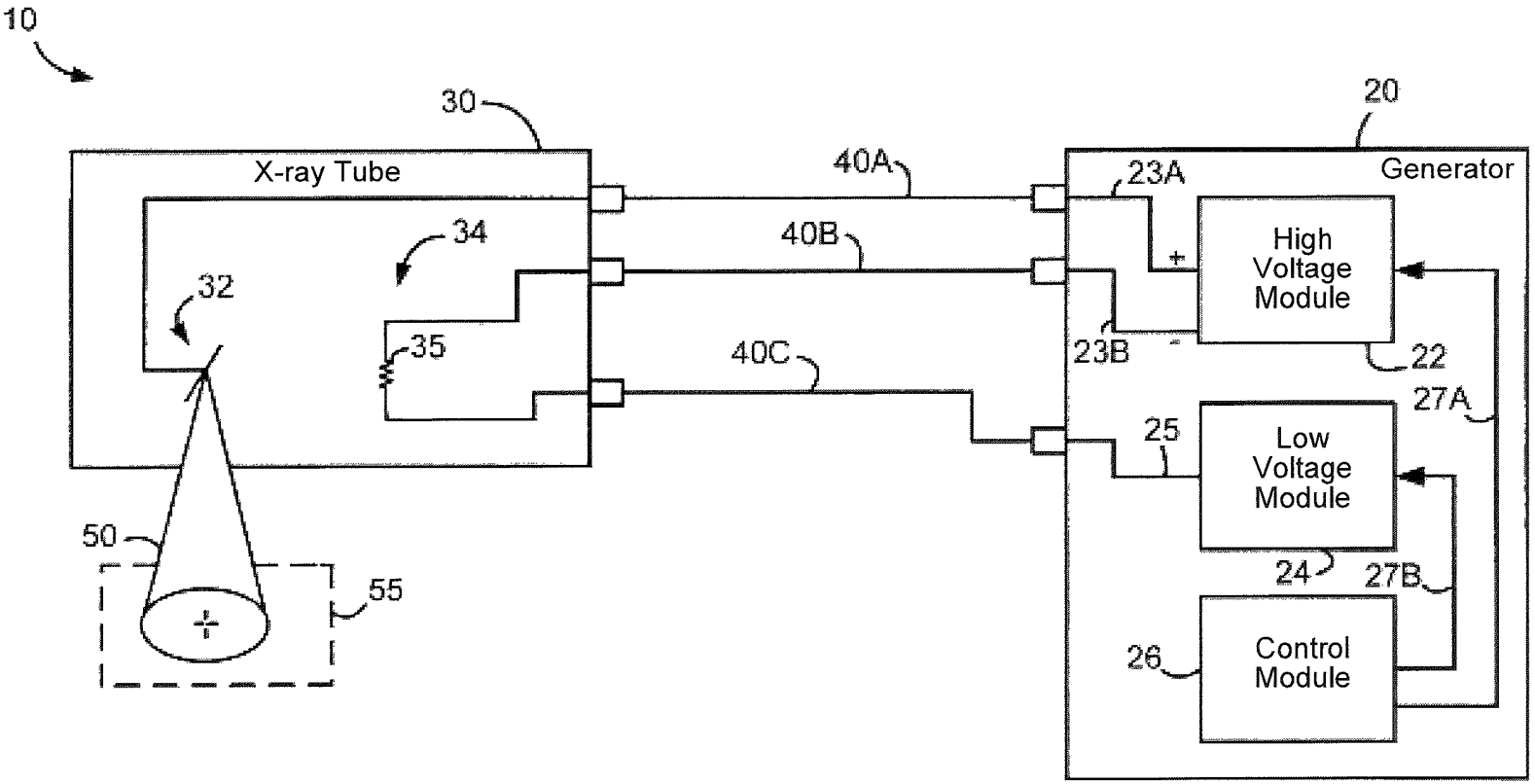
FIG. 1 is a schematic view of an exemplary X-ray imaging system according to various embodiments of the present disclosure.

Referring now to FIG. 1, an exemplary X-ray imaging system according to various embodiments of the present disclosure is generally indicated by reference numeral 10. In the example shown, the imaging system 10 comprises an O-arm® imaging device sold by Medtronic Navigation, Inc. having a place of business in Louisville, Colo., USA. One skilled in the art will appreciate, however, that the teachings of the present disclosure can be utilized with any imaging system/device. X-ray imaging system 10 can include an X-ray generator 20, an X-ray tube 30 and a plurality of connector cables 40A, 40B and 40C. The X-ray generator 20 can include a high voltage module 22, a low voltage module 24 and a control module 26. A first output 23A of the high voltage module 22 can be connected to an anode 32 of X-ray tube 30. A second output 23B of the high voltage module 22 can be connected to a cathode 34 of X-ray tube 30. In this manner, the high voltage module 22 can supply a dosing voltage across the X-ray tube 30, i.e., across anode 32 and cathode 34. The magnitude of the dosing voltage can vary, for example, between 40 kV to 150 kV depending on the procedure being performed, the subject being imaged, etc.

An output 25 of the low voltage module 24 can be coupled to a filament 35 of the X-ray tube 30. When the high voltage module 22 supplies the dosing voltage across the X-ray tube 30 and the low voltage module 24 supplies a dosing current through the filament 35, the X-ray tube 30 can generate an X-ray emission 50 that irradiates a target 55 to be imaged (for example, a patient). Control module 26 can provide a first control output 27A to high voltage module 22 and a second control output 27B to low voltage module 24. First and second control outputs 27A, 27B can control the high voltage module 22 and low voltage module 24, respectively, to vary the characteristics (intensity, energy, duration, etc.) of X-ray emission 50.

The X-ray generator 20 can be coupled to the X-ray tube 30 with a plurality of connector cables 40A, 40B, and 40C. In some embodiments, connector cables 40A and 40B can couple the high voltage module 22 to the X-ray tube 30 and connector cable 40C can couple the low voltage module 24 with the X-ray tube 30. In these embodiments, connector cables 40A and 40B can comprise triaxial cables, discussed more fully below, and connector cable 40C can comprise a coaxial, triaxial or any other cable suitable for providing a dosing current to the filament 35 of the X-ray tube 30.

Figure 2:
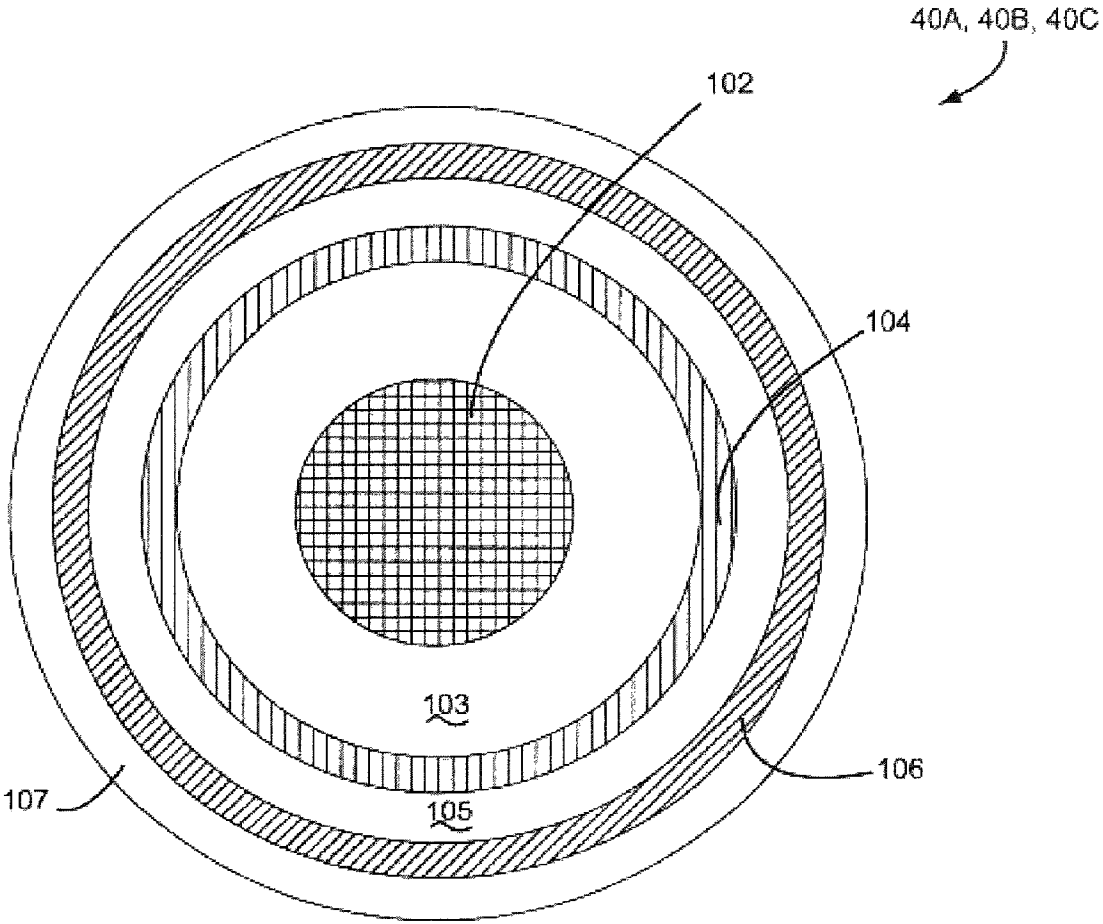
FIG. 2 is a schematic sectional view of an exemplary connector cable of the X-ray imaging system illustrated in FIG. 1.

Referring now to FIG. 2, a sectional view of an exemplary connector cable 40A, 40B, 40C constructed in accordance with the present disclosure is illustrated. In the illustrated example, connector cable 40A, 40B, 40C comprises a triaxial cable that can include a center conductor 102, an inner shield conductor 104 and an outer shield conductor 106 arranged concentrically. Each of these conductors 102, 104, 106 can be electrically isolated from one another by an insulative layer. For example, center conductor 102 can be electrically insulated from inner shield conductor 104 by a first insulative layer 103 and inner shield conductor 104 can be electrically insulated from outer shield conductor 106 by a second insulative layer 105. Furthermore, an outer insulative layer 107 can surround and encapsulate center conductor 102, inner and outer shield conductors 104, 106 and first and second insulative layers 103, 105.

In a conventional coaxial cable, in which a center conductor is surrounded by a shield conductor, the capacitance that exists between the center conductor (carrying a voltage signal) and the shield conductor (carrying electrical ground) can extend the time required for the center conductor to reach the intended voltage magnitude of the voltage signal. That is, the rise time of the voltage signal carried by the center conductor can be extended due to capacitive effects of the coaxial cable. In the present disclosure, a triaxial cable can be utilized to reduce or eliminate the capacitance of the connector cable 40A, 40B, 40C. This can be accomplished, for example, by carrying a precharge voltage on the inner shield conductor 104 to reduce the capacitance between the inner conductor 102 and the outer shield conductor 106.

Figure 3:
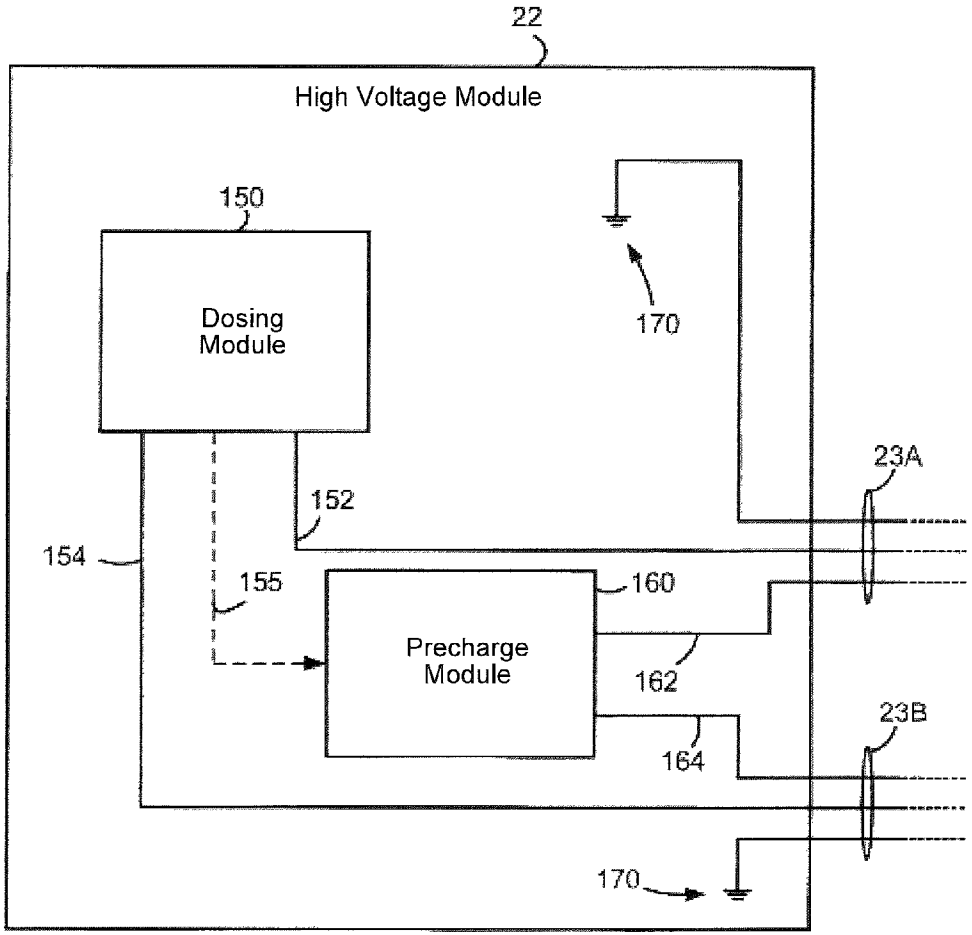
FIG. 3 is a schematic view of an exemplary high voltage module of the X-ray imaging system illustrated in FIG. 1.

Referring now to FIG. 3, an exemplary high voltage module 22 according to various embodiments of the present disclosure is illustrated. High voltage module 22 can include a dosing module 150, a precharging module 160 and an electrical ground 170. Dosing module 150 can be configured to determine the dosing voltage to be provided to X-ray tube 30, for example, based on first control input 27A, operator input and/or other factors. The dosing voltage can be supplied to the X-ray tube 30 over connector cable 40A as part of the first output 23A of the high voltage module 22 and over connector cable 40B as part of the second output 23B of the high voltage module 22. Signal lines 152, 154 can provide the dosing voltage to the first and second outputs 23A, 23B, respectively. In various embodiments, the dosing voltage signal can be a square wave pulse.

Precharging module 160 can determine and supply a precharge voltage to one or both of the connector cables 40A, 40B through signal lines 162, 164, respectively. In some embodiments, the precharge voltage can be determined based on the dosing voltage determined by dosing module 150. For example, a dosing indicator signal 155 can be output from dosing module 150 to precharging module 160. Dosing indicator signal 155 can include information pertaining to the magnitude, duration, timing and/or other aspects of the dosing voltage that will be sent to X-ray tube 30. The precharging module 160 can determine the appropriate precharge voltage to supply to one or both of the connector cables 40A, 40B. The factors upon which the precharging module 160 relies to determine the precharge voltage include, but are not limited to, the dosing indicator signal 155 (the magnitude, duration, timing and/or other aspects of the dosing voltage) and the characteristics (capacitance, length, etc.) of connector cables 40A, 40B. Similar to the dosing voltage signal, in various embodiments the precharge voltage signal can be a square wave pulse.

In some embodiments, the dosing voltage signal can be carried by the center conductor 102 of connector cable 40A, 40B. The precharge voltage signal can be carried by the inner shield conductor 104. The outer shield conductor 106 can carry a ground signal from electrical ground 170, e.g., to provide shielding.

The precharge voltage can be determined by the precharging module 160 in order to reduce the effects of capacitance on the connecting cables 40A, 40B, 40C. The arrangement of the conductors 102, 104, 106 can result in a capacitance (i) between center conductor 102 and inner shield conductor 104 and (ii) between inner shield conductor 104 and outer shield conductor 106. When applying a voltage differential across the conductors, the capacitance can delay the charging time. As stated above, the charging of the center conductor 102 can be delayed due to capacitive effects. For example, the rise time of a square wave pulse dosing voltage signal can be increased due to capacitive effects. These effects can be reduced, and the charging delay and rise time can be decreased, by precharging the inner shield conductor 104 to a precharge voltage that is equal or approximately equal to the magnitude of the dosing voltage.

The precharge voltage can be provided to the inner shield conductor 104 before the dosing voltage is provided to the center conductor 102. In some embodiments, the control module 26, alone or in combination with dosing module 150 and/or precharging module 160, can determine a precharge delay, i.e., the period of time between a first time when the precharge voltage is supplied to the inner shield conductor 104 and a second time when the dosing voltage 102 is supplied to the center conductor 102. The precharge delay can be determined to reduce and/or eliminate the capacitive effects on connector cables 40A, 40B, 40C. For example, the precharge delay can be based on the magnitude of the dosing voltage, the expected charging delay and/or other factors. In some embodiments, the precharge delay can be determined by monitoring the current provided by the precharging module 160 to the inner shield conductor 104. When the current provided by the precharging module 160 to the inner shield conductor 104 drops below a threshold level (or reaches zero), it can be assumed that the inner shield conductor 104 has reached or approximates the precharge voltage.

The precharge voltage signal can also have a longer duration than the dosing voltage. The application of the precharge voltage to the inner shield conductor 104 before the application of the dosing voltage to the center conductor 102, in addition to maintaining the inner shield conductor 104 at the precharge voltage for a longer duration than the duration of the dosing voltage, can ameliorate the capacitive effects on the connector cables 40A, 40B, 40C. In this manner, the charging delay for center conductor 102 can be reduced or eliminated, thereby improving image quality and/or dosage control of the X-ray imaging system 10.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An X-ray imaging system comprising:

an X-ray tube configured to generate an X-ray emission, the X-ray tube including an anode, a cathode and a filament;

an X-ray generator coupled with the X-ray tube and including a high voltage module and a low voltage module, the high voltage module being configured to supply a dosing voltage across the X-ray tube and the low voltage module being configured to supply a dosing current to the filament;

a precharging module coupled with the X-ray generator and configured to supply a precharge voltage; and a triaxial cable electrically connecting the X-ray generator to the X-ray tube, the triaxial cable including a center conductor, an inner shield conductor surrounding the center conductor and an outer shield conductor surrounding the center conductor and the inner shield conductor, wherein the outer shield conductor carries a ground voltage, the inner shield conductor carries the precharge voltage and the center conductor carries the dosing voltage, and wherein the precharging module supplies the precharge voltage to the inner shield conductor at a first time, the X-ray generator supplies the dosing voltage to the center conductor at a second time, and the second time is different than the first time.

2. The X-ray imaging system of claim 1, wherein the dosing voltage equals the precharge voltage in magnitude.

3. The X-ray imaging system of claim 1, wherein the precharge voltage is based on the dosing voltage.

4. The X-ray imaging system of claim 1, wherein:

the second time is later than the first time; and a difference between the first time and second time is a precharging delay.

5. The X-ray imaging system of claim 4, wherein the precharging delay is based on the dosing voltage.

6. The X-ray imaging system of claim 5, wherein the precharging delay is based on a magnitude of the dosing voltage.

7. The X-ray imaging system of claim 1, wherein the dosing voltage comprises a first square wave pulse having a first magnitude and the precharge voltage comprises a second square wave pulse having a second magnitude.

8. The X-ray imaging system of claim 7, wherein the precharge voltage is based on the dosing voltage.

9. The X-ray imaging system of claim 8, wherein the first magnitude is equal to the second magnitude.

10. The X-ray imaging system of claim 9, wherein:

the second time is later than the first time; and a difference between the first time and second time is a precharging delay.

11. The X-ray imaging system of claim 10, wherein the precharging delay is based on the dosing voltage.

12. The X-ray imaging system of claim 11, wherein the precharging delay is based on the first magnitude of the dosing voltage.

13. An X-ray imaging system comprising:

an X-ray tube configured to generate an X-ray emission, the X-ray tube including an anode, a cathode and a filament;

an X-ray generator coupled with the X-ray tube and including a high voltage module and a low voltage module, the high voltage module being configured to supply a dosing voltage across the X-ray tube and the low voltage module being configured to supply a dosing current to the filament;

a dosing module configured to generate a dosing indicator signal based on the dosing voltage, wherein the dosing indicator signal is provided separate from the dosing voltage;

a precharging module coupled with the X-ray generator and configured to set a precharge voltage based on the dosing indicator signal, and supply the precharge voltage across the X-ray tube; and a triaxial cable electrically connecting the X-ray generator to the X-ray tube, the triaxial cable including a center conductor, an inner shield conductor surrounding the center conductor and an outer shield conductor surrounding the center conductor and the inner shield conductor, wherein the outer shield conductor carries a ground voltage, the inner shield conductor carries the precharge voltage and the center conductor carries the dosing voltage.

14. The X-ray imaging system of claim 13, wherein the dosing indicator signal includes information relating to one or more of a magnitude of the dosing voltage, a duration of the dosing voltage and timing of the dosing voltage.

15. The X-ray imaging system of claim 13, wherein the dosing voltage equals the precharge voltage in magnitude.

16. The X-ray imaging system of claim 13, wherein:

the precharging module supplies the precharge voltage to the inner shield conductor at a first time and the X-ray generator supplies the dosing voltage to the center conductor at a second time later than the first time; and a difference between the first time and second time is a precharging delay.

17. The X-ray imaging system of claim 16, wherein the precharging delay is based on the dosing voltage.

18. The X-ray imaging system of claim 17, wherein the precharging delay is based on a magnitude of the dosing voltage.

19. The X-ray imaging system of claim 13, wherein the dosing module is configured to generate the dosing indicator signal based on a duration of the dosing voltage.

20. The X-ray imaging system of claim 13, wherein:

the high voltage module comprises the dosing module and the precharging module;

the dosing module supplies the dosing voltage separate from the dosing indicator signal and across the X-ray tube; and the precharging module supplies the precharge voltage to the center conductor of the triaxial cable.

21. A method comprising:

providing an X-ray tube including an anode, a cathode and a filament;

providing an X-ray generator;

connecting the X-ray tube to the X-ray generator with a triaxial cable, the triaxial cable including a center conductor, an inner shield conductor surrounding the center conductor and an outer shield conductor surrounding the center conductor and the inner shield conductor;

supplying a precharge voltage to the inner shield conductor of the triaxial cable;

while supplying the precharge voltage to the inner shield conductor, supplying a dosing voltage across the X-ray tube, wherein the dosing voltage is carried by the center conductor of the triaxial cable; and supplying a dosing current to the filament while supplying the dosing voltage across the X-ray tube to generate an X-ray emission, wherein the precharge voltage is supplied to the inner shield conductor at a first time, the dosing voltage is supplied to the center conductor at a second time, and the second time is different than the first time.

22. The method of claim 21, wherein the precharge voltage is based on the dosing voltage such that a charge delay of the triaxial cable is reduced.

23. An X-ray imaging system comprising:

an X-ray tube configured to generate an X-ray emission, the X-ray tube including an anode, a cathode and a filament;

an X-ray generator coupled with the X-ray tube and including a high voltage module and a low voltage module, the high voltage module being configured to supply a dosing voltage across the X-ray tube and the low voltage module being configured to supply a dosing current to the filament;

a precharging module coupled with the X-ray generator and configured to supply a precharge voltage;

a connector cable electrically connecting the low voltage module to the X-ray tube; and two triaxial cables electrically connecting the high voltage module to the X-ray tube, wherein each of the triaxial cables includes a center conductor, an inner shield conductor surrounding the center conductor, and an outer shield conductor surrounding the center conductor and the inner shield conductor, wherein the outer shield conductor carries a ground voltage, the inner shield conductor carries the precharge voltage, the center conductor carries the dosing voltage, the precharge voltage is based on the dosing voltage to reduce a capacitance of the two triaxial cables, wherein a first one of the triaxial cables comprises a first end and a second end, the first end is connected to the high voltage module, the second end is connected to the anode, a second one of the triaxial cables comprises a third end and a fourth end, the third end is connected to the high voltage module, and the fourth end is connected to the cathode.

24. The X-ray imaging system of claim 23, wherein the dosing voltage equals the precharge voltage in magnitude.

25. The X-ray imaging system of claim 24, wherein:

the precharging module supplies the precharge voltage to the inner shield conductor at a first time and the X-ray generator supplies the dosing voltage to the center conductor at a second time later than the first time; and a difference between the first time and second time is a precharging delay.

26. The X-ray imaging system of claim 25, wherein the precharging delay is based on the dosing voltage.

27. The X-ray imaging system of claim 26, wherein the dosing voltage has a first duration and the precharging voltage has a second duration greater than the first duration.

28. The X-ray imaging system of claim 23, wherein the cathode is connected between the second one of the triaxial cables and the low voltage module.

29. The X-ray imaging system of claim 23, wherein:

the fourth end is connected to the filament; and the filament is connected between the second one of the triaxial cables and the low voltage module.

30. An X-ray imaging system comprising:

an X-ray tube configured to generate an X-ray emission, the X-ray tube including an anode and a cathode;

an X-ray generator coupled with the X-ray tube and including a high voltage module and a low voltage module, wherein the high voltage module is configured to supply a dosing voltage across the X-ray tube to the cathode and the anode, wherein the low voltage module is configured to supply a dosing current to the cathode, and wherein the cathode is electrically connected between the high voltage module and the low voltage module;

a precharging module coupled with the X-ray generator and configured to supply a precharge voltage; and a triaxial cable electrically connecting the X-ray generator to the X-ray tube, the triaxial cable including a center conductor, an inner shield conductor surrounding the center conductor and an outer shield conductor surrounding the center conductor and the inner shield conductor, wherein the outer shield conductor carries a ground voltage, wherein the inner shield conductor carries the precharge voltage, and wherein the center conductor carries the dosing voltage.

31. The X-ray imaging system of claim 30, wherein:

the high voltage module comprises a first terminal and a second terminal;

the first terminal is connected to the anode;

the second terminal is connected to the cathode;

the high voltage module supplies the dosing voltage across the first terminal and the second terminal;

the low voltage module comprises a third terminal; and the third terminal is connected to the cathode.

32. The X-ray imaging system of claim 31, wherein the low voltage module supplies the dosing current to the cathode via the third terminal.

33. The X-ray imaging system of claim 30, wherein:

the high voltage module comprises a first terminal and a second terminal;

the first terminal is connected to the anode;

the second terminal is connected to a filament of the cathode;

the high voltage module supplies the dosing voltage across the first terminal and the second terminal;

the low voltage module comprises a third terminal;

the third terminal is connected to the filament; and the low voltage module supplies the dosing current to the filament via the third terminal.

34. The X-ray imaging system of claim 30, wherein:

the cathode has a first terminal and a second terminal;

at least one of the high voltage module provides the dosing voltage across the anode and the first terminal of the cathode, and the precharging module supplies the precharge voltage across the anode and the first terminal of the cathode; and the low voltage module supplies the dosing current to the second terminal of the cathode.

35. The X-ray imaging system of claim 34, wherein:

the high voltage module provides, via the triaxial cable and a second cable, the dosing voltage across the anode and the first terminal of the cathode;

the precharging module supplies, via the triaxial cable and the second cable, the precharge voltage across the anode and the first terminal of the cathode; and the low voltage module supplies, via a connector cable, the dosing current to the second terminal of the cathode.

36. The X-ray imaging system of claim 30, wherein the precharging module is configured to supply the precharge voltage across the X-ray tube to provide a corresponding potential difference between the anode and the cathode of the X-ray tube.

37. The X-ray imaging system of claim 30, wherein the cathode is connected, via the triaxial cable, to both the high voltage module and the low voltage module.

38. A method comprising:

providing an X-ray tube including an anode, a cathode and a filament;

providing an X-ray generator;

connecting the X-ray tube to the X-ray generator with a triaxial cable, the triaxial cable including a center conductor, an inner shield conductor surrounding the center conductor and an outer shield conductor surrounding the center conductor and the inner shield conductor;

supplying a precharge voltage across the X-ray tube to the inner shield conductor of the triaxial cable;

while supplying the precharge voltage to the inner shield conductor, supplying a dosing voltage across the X-ray tube, wherein the dosing voltage is carried by the center conductor of the triaxial cable, and wherein the dosing voltage equals the precharge voltage in magnitude; and supplying a dosing current to the filament while supplying the dosing voltage across the X-ray tube to generate an X-ray emission.

* * * * *